US006896529B2

(12) United States Patent
Jing

(10) Patent No.: US 6,896,529 B2
(45) Date of Patent: May 24, 2005

(54) CONNECTOR EQUIPPED WITH TERMINAL PROTECTION DEVICE

(75) Inventor: Lu Jing, Wuxi (CN)

(73) Assignee: Molex Incorporated, Lisle, IL (US)

( * ) Notice: Subject to any disclaimer, the term of this patent is extended or adjusted under 35 U.S.C. 154(b) by 62 days.

(21) Appl. No.: 10/697,621

(22) Filed: Oct. 29, 2003

(65) Prior Publication Data

US 2004/0121656 A1 Jun. 24, 2004

(30) Foreign Application Priority Data

Oct. 29, 2002 (CN) ..... 02 2 82716

(51) Int. Cl.[7] ..... H01R 13/44
(52) U.S. Cl. ..... 439/135; 439/521
(58) Field of Search ..... 439/271, 367, 439/812, 893, 695, 135, 144, 426, 521, 892

(56) References Cited

U.S. PATENT DOCUMENTS 5,542,852 A * 8/1996 Hsueh ..... 439/135
6,530,786 B2 * 3/2003 Ishikawa ..... 439/79

* cited by examiner

*Primary Examiner*—Briggitte R. Hammond
(74) *Attorney, Agent, or Firm*—Stephen Z. Weiss

(57) ABSTRACT

A connector equipped with a terminal protection device including an insulated housing and terminals. The insulated housing includes a plurality of terminal cavities to receive the terminals, and the two ends of the terminals extend beyond the insulating housing. The terminal protection device fixed at the rear portion of the insulated housing has terminal slots characterized by a shape corresponding to the tail portion of the terminal so that the tail portion of the terminal can penetrate the terminal slot and can be locked by the terminal slot. The terminal slot can be either open on both sides or covered by a seal layer. The surface of the terminal protection device facing the rear portion of the insulated housing is provided with fixing protuberances for fixing the terminal protection device to the rear of the insulated housing. In addition, fixing protuberances and a filling protuberance are disposed on the same surface, with a view to fixing and filling, respectively.

7 Claims, 5 Drawing Sheets

CONNECTOR EQUIPPED WITH TERMINAL PROTECTION DEVICE

BACKGROUND OF THE INVENTION (A) Field of the Invention

The present invention is related to a connector, more specifically, to a connector equipped with a terminal protection device, which may be used for cellular phone battery chargers.

(B) Description of the Related Art

At present, a connector that connects a cellular phone battery charger and a cellular phone is usually composed of an insulated housing and terminals. The insulated housing has a head portion and a rear portion which are opposite to each other. In addition, the insulated housing comprises a plurality of terminal cavities penetrating from the head portion to the rear portion. The terminals are inserted into their respective terminal cavities, but their two ends extend behind the terminal cavities. The middle of each terminal is designed to be flexible. One end of each terminal is connected to a cable while the other end is designed to engage a mating terminal.

FIG. 9 illustrates a connector 9 made by an existing method of the terminal being inserted into the terminal cavities. Glue 91 is manually applied to the periphery of the terminal cavities 92 near the rear portion of the insulation case 90 not only to fix the terminals 93 but also to close the glued side of the terminal cavities 92 to prevent the flow of plastic into the cavities during the over mold process. However, the existing method has the following drawbacks. The production is inefficient, as connectors are glued one by one. The insertion quality is poor because the glue alone may not adequately fix the terminals 93, allowing them to be pushed outward. Because the glued side of the terminal cavities 92 is not blocked, some of the plastic during the over mold process may enter the terminal cavities 92. Furthermore, during the insertion process, glue 91 is likely to permeate into the terminal cavities 92, and thus the elastic portions of the terminals 93 are eventually glued to the walls of the terminal cavities 92.

SUMMARY OF THE INVENTION

In order to solve the underlying problems in the existing method, namely inconsistent performance of terminals and inefficient production, the present invention provides a connector equipped with a terminal protection device so as to enable mass production and promote the performance of terminals.

The connector, in accordance with the present invention, essentially comprises an insulated housing, at least one terminal cavity, at least one terminal and a terminal protection device. The insulated housing has a head portion and a rear portion which are opposite to each other. Formed inside the insulated housing, the terminal cavity penetrates the insulated housing from the head portion to the rear portion. The terminal is received in the respective terminal cavity. The terminal protection device, fixed to the rear portion of the insulated housing, is a piece of plastic plate, and has at least one terminal slot which fits the tail portion of the terminal so that the tail portion of the terminal can penetrate the terminal slot and can be locked in the terminal slot.

Each terminal slot is inwardly ladder-shaped, and is provided with an anterior part, a barb, and a posterior part from the side of the terminal protection device facing the rear portion to the other side. The posterior part is narrower than the anterior part. Moreover, the posterior part can be open on both sides or covered by a thin seal layer.

The surface of the terminal protection device facing the tail portion of the insulation case is provided with at least one fixing protuberance for fixing the terminal protection device to the tail portion of the insulation case. Moreover, on the same surface of the terminal protection device, there are at least one positioning protuberance and at least one filling protuberance, in which the positioning protuberance fits into a positioning slot disposed at the rear portion of the insulated housing. The filling protuberance coperates to fill a notch at the rear portion of the insulated housing which notch is at the rear of the terminal cavity having the terminal with a head portion which extends further beyond its terminal cavity as compared with the head portions of the other terminals.

The benefits of the present invention are shown as follows. Production efficiency is increased by processing four to eight connectors simultaneously. Material cost is markedly reduced by making terminal protection devices from cheap materials like plastic. The performance of the terminals is enhanced, as the terminals are prevented from being pushed outward due to frequent contact with mating terminals and a portion of the insulated housing is stopped from entering the terminal cavity the moment the stress relief is in the process of over mold. Also, the structure is simple.

DETAIL DESCRIPTION OF THE INVENTION

The following description, associated with the attached drawings, illustrates a preferred embodiment of the present invention.

Figure 1:
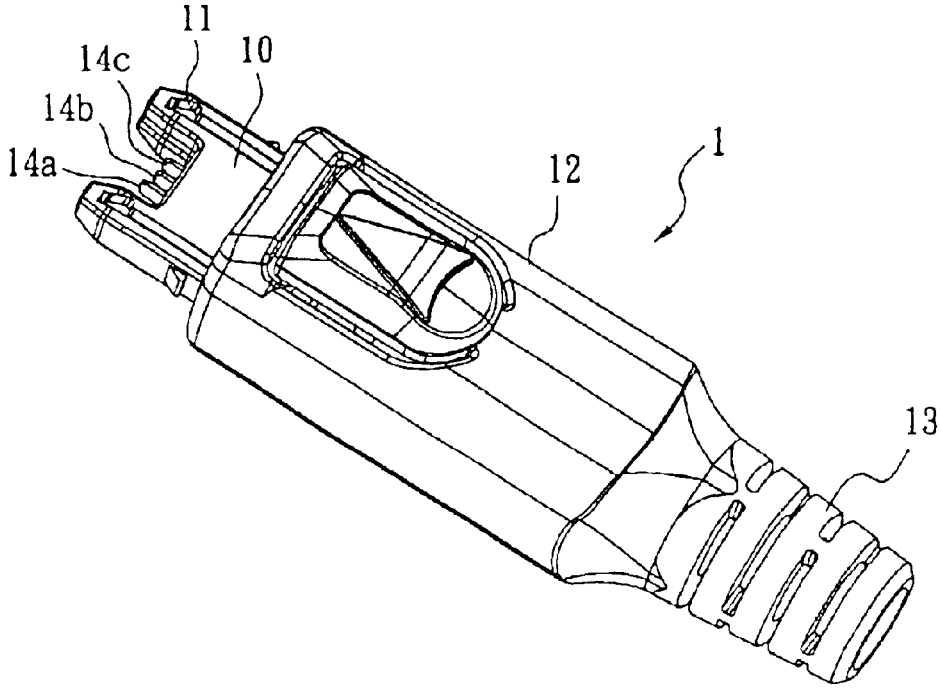
FIG. 1 illustrates a three-dimensional view of a preferred embodiment according to the present invention.
Figure 2:
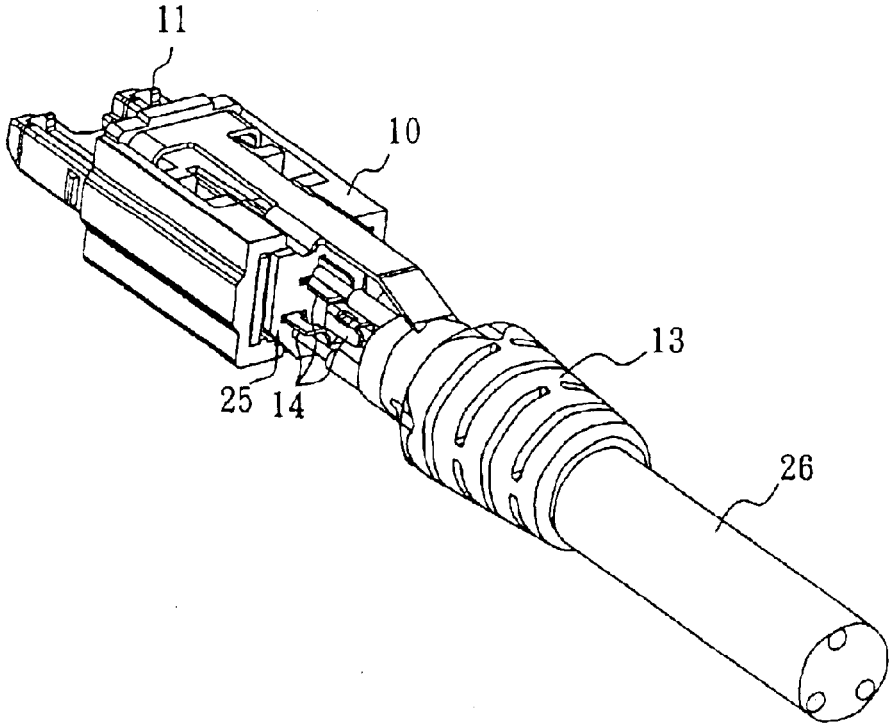
FIG. 2 illustrates a three-dimensional view of the preferred embodiment depicted in FIG. 1 after the outer insulated mold has been removed therefrom.

As shown in FIG. 1, a connector 1 in accordance with the present invention is a plug connector (though the application of the present invention is not limited to this type of connectors), including an exteriorly disposed insulated cover 12 intended for the protection of the circuit inside. A stress relief collar 13 is connected to the rear of the insulated cover 12. Moreover, lock arms 11 with locks are formed on both sides of the plug connector 1 (as shown in FIGS. 2, 3, 7 and 8) to prevent the detachment of the plug connector 1 from a corresponding connector to which it has been connected.

Figure 3:
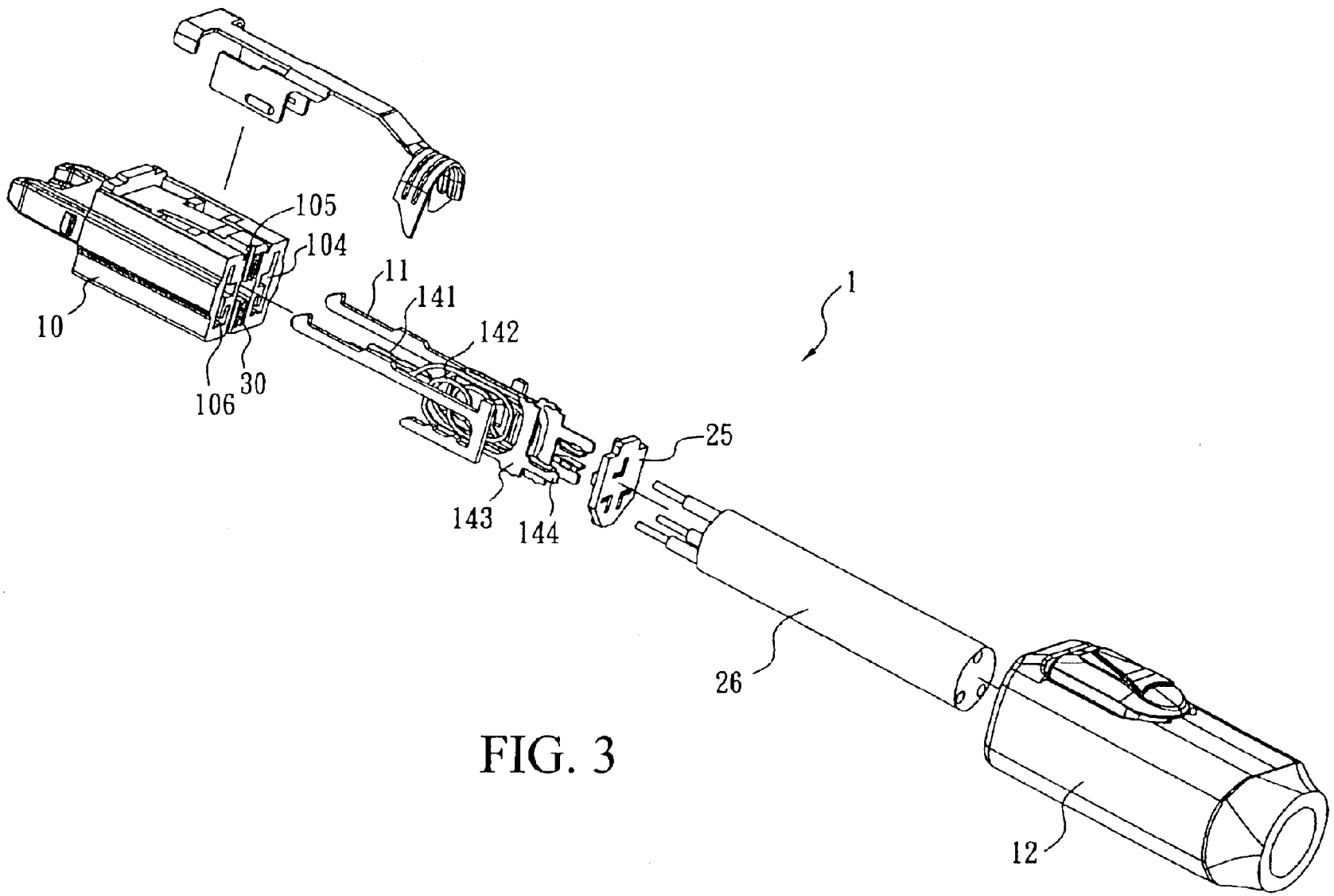
FIG. 3 illustrates a three-dimensional exploded view of the structure of the preferred embodiment depicted in FIG. 1.
Figure 4:
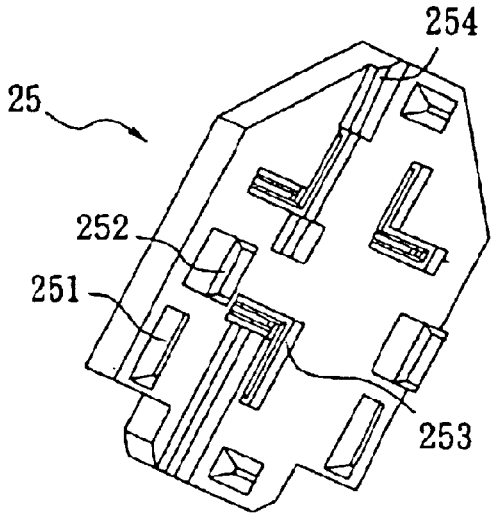
FIG. 4 illustrates a three-dimensional view of the terminal protection device in accordance with the present invention.
Figure 5:
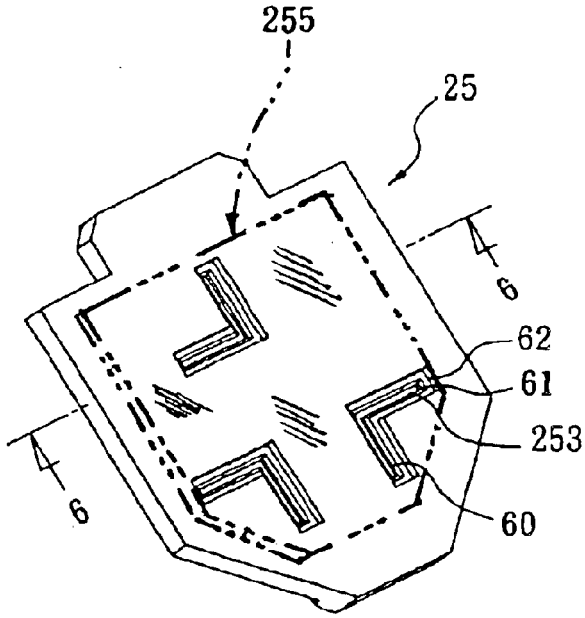
FIG. 5 illustrates a three-dimensional view of the terminal protection device depicted in FIG. 4, viewed from another angle.
Figure 6:
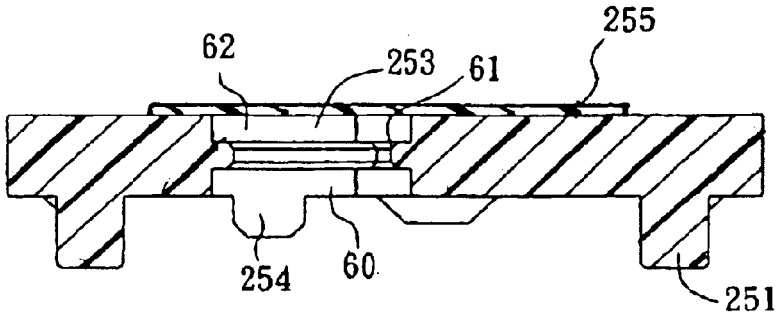
FIG. 6 illustrates a cross-sectional view taken along the line 6—6 of FIG. 5.
Figure 7:
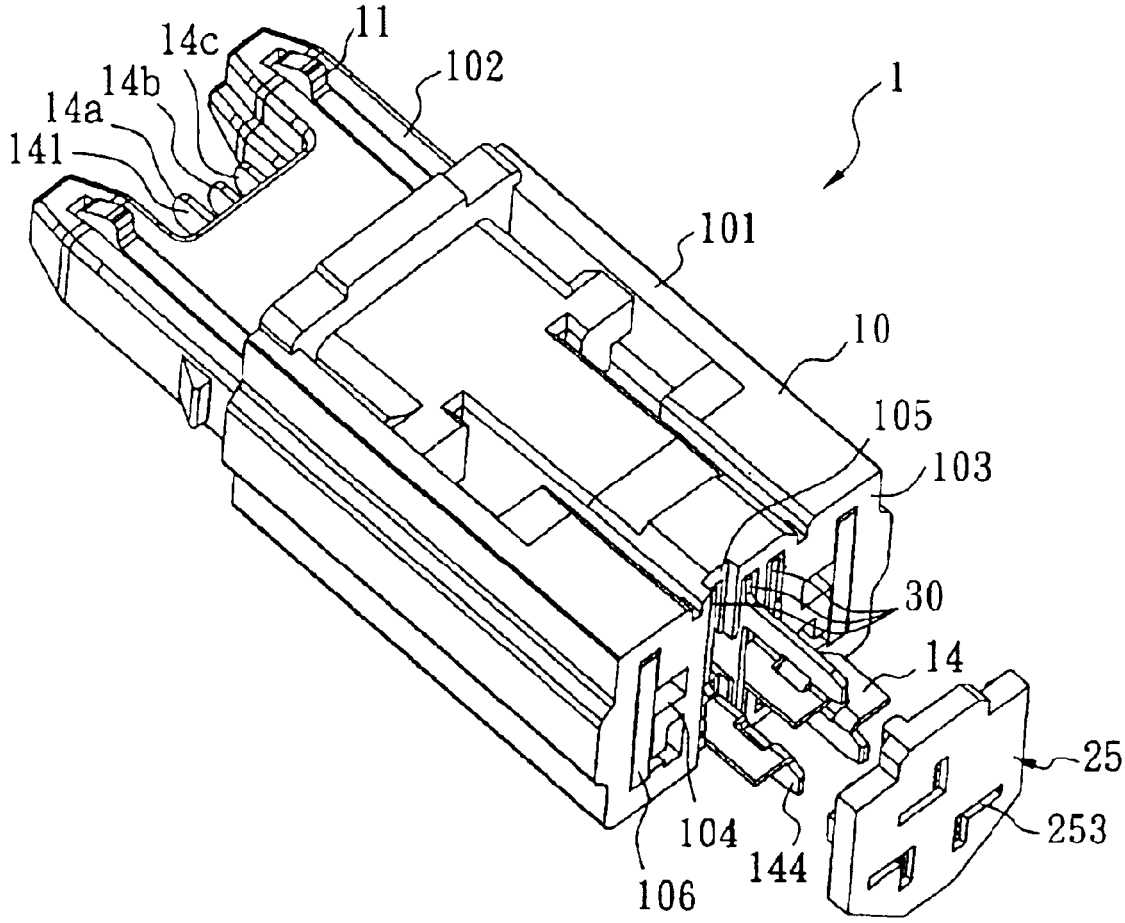
FIG. 7 illustrates the structure of the terminal protection device of the preferred embodiment depicted in FIG. 1 before soldering.

As shown in FIG. 7, the plug connector 1 essentially comprises an insulated housing 10, three terminals 14, three terminal cavities 30 and a terminal protection device 25. The insulated housing 10 has a base 101 whose two ends extend to such an extent to form a U-shaped head portion 102 and a rear portion 103, respectively. The terminal cavities 30 formed in the interior of the insulated housing 10 penetrate from the middle, transverse portion of the U-shaped head portion 102 to the rear portion 103. Holding slots 106 penetrate from a point near the top of the side arm of the U-shaped head portion 102 to the rear portion 103 for receiving the lock arms 11. Positioning slots 104 installed in the two sides of the rear portion 103 are disposed adjacent the holding slots 106 and the terminal cavities 30. The three terminals 14 of the plug connector 1, namely the first terminal 14*a*, the second terminal 14*b* and the third terminal 14*c*, are of the same length. The structure of the terminals 14 is best illustrated in FIG. 3. Each terminal 14 comprises a head portion 141, an annular elastic portion 142, a plate 143 and an L-shaped tail portion 144, where the head portion 141 is designed to engage a terminal in a corresponding connector, the annular elastic portion 142 extends from the head portion 141, the plate 143 extends from the elastic portion 142 and also upward, and the L-shaped tail portion 144 extends from the plate 143 and is connected to a conductor in cable 26.

Figure 8:
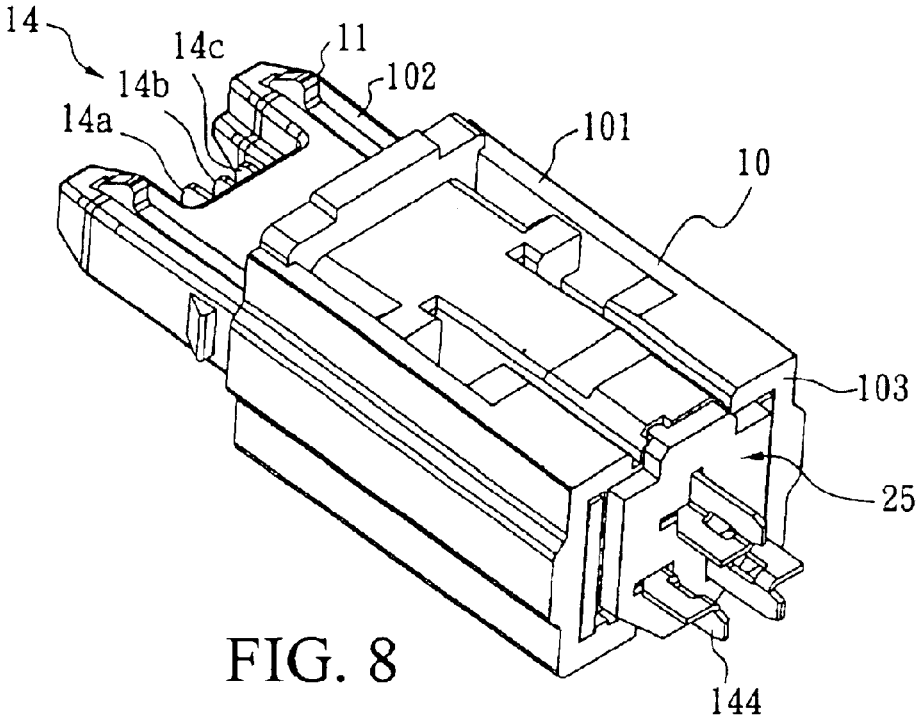
FIG. 8 illustrates the structure of the terminal protection device of the preferred embodiment depicted in FIG. 1 after soldering.
Figure 9:
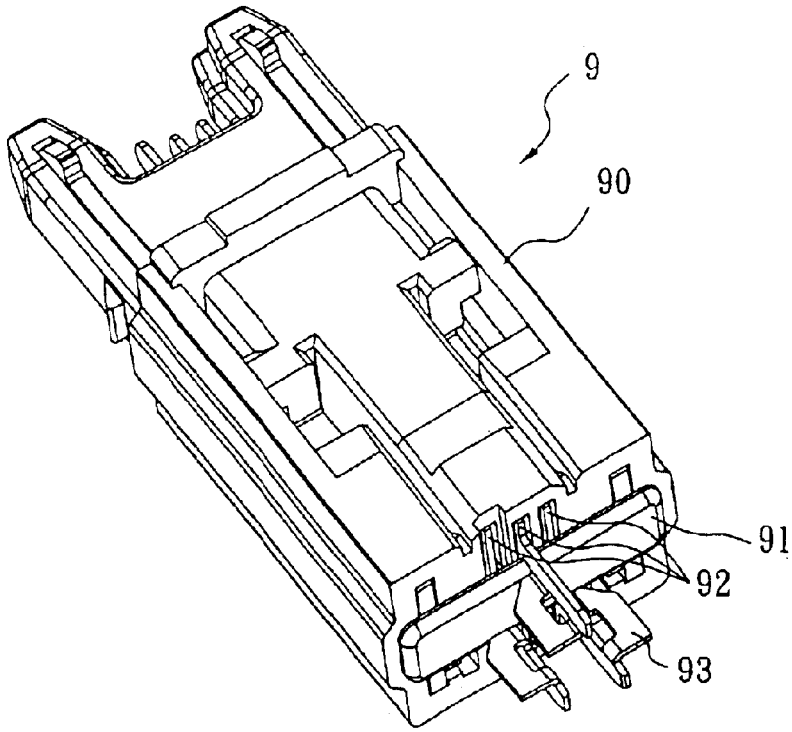
FIG. 9 (Prior Art)
FIG. 9 illustrates a three-dimensional view of a connector produced with the existing techniques after the insulation case has been removed therefrom.

As shown in FIGS. 1, 2, 3, 7 and 8, each terminal cavity 30 accommodates the corresponding terminal 14, but the head portion 141 and rear portion 144 of each terminal 14 extend beyond the terminal cavity 30. The head portion 141 of the first terminal 14*a* extends further beyond the terminal cavity 30 than the other two terminals 14*b* and 14*c* (as shown in FIGS. 1, 7 and 8.) Although all the three terminals 14 are of the same length, to account for the extended length beyond the terminal cavity 30, the plate 143 of the first terminal 14*a* lies in a plane different from the plane in which the plates 143 of the other two terminals 14*b* and 14*c* lie. This different plane is defined by notch 105 formed in rear portion 103 of insulated housing 10.

As shown in FIGS. 2 and 4 through 8, the terminal protection device 25 is a piece of plastic plate fixed to the rear portion 103 of the insulated housing 10.

The terminal protection device 25 has three L-shaped terminal slots 253 which include walls having an inwardly C-shaped cross section. Each terminal slot 253 includes an anterior part 60, a barb 61 and a posterior part 62, where the posterior part 62 is narrower than the anterior part 60. Although the entire terminal slot 253 is open on both sides, the posterior part 62 may be covered by a thin seal layer 255. The position and width of slot 253 is designed to be penetrated by the rear portion 144 of the terminal 14, and to be held by plate 143. The depth of the terminal slot 253 is equivalent to the thickness of the terminal protection device 25. It is important to ensure that, after the rear portion 144 of the terminal 14 has pierced the terminal protection device 25, the protruding portion of the tail portion 144 is long enough to be connected to the cable 26 firmly.

Seven protuberances are formed on the surface of the terminal protection device 25 facing the rear portion 103. Four of them characterized by the shape of a triangular prism are known as fixing protuberances 251, which correspond to four different positions of the rear portion 103 for fixing the terminal protection device 25 to the rear portion 103. Two other protuberances having the shape of a quadrilateral prism are known as positioning protuberances 252 which correspond to the respective positioning slots 104 at the rear portion 103 for positioning during assembly. An elongated filling protuberance 254 is formed at the terminal protection device 25 along the longitudinal direction of the terminal protection device 25. The middle of the filling protuberance 254 is interrupted by the two terminal slots 253 corresponding to the first terminal 14*a* and the second terminal 14*b* (see FIGS. 4 and 6). The purpose of the elongated filling protuberance 254 is to prevent the terminal 14*a* from being pushed outward, by filling the notch 105 which notch allows the head portion 141 of the first terminal 14*a* to stick out of the corresponding terminal cavity 30 at the head portion 102 of the insulated housing 10 to a greater extent as compared with the head portions 141 of the two other terminals 14*b*, 14*c*.

As shown in FIGS. 7 and 8, when the terminal protection device 25 is being fixed to the rear portion 103, the two positioning protuberances 252 are pointed at the positioning slots 104 on the insulated housing 10 respectively. Then, the terminal protection device 25 is pressed against the rear portion 103 of the insulated housing 10 along the tail portion 144 of the terminal 14 to make the positioning protuberances 252 tightly fit into the positioning slots 104. The tail portion 144 of the terminal 14 is inserted into the anterior part 60 first, and then the tail portion 144 penetrates the posterior part 62 through the barb 61. Afterward, the fixing protuberances 251 and the rear portion 103 of the insulated housing 10 are joined together by means of ultrasonic and soldering techniques, with a view to fixing the terminal protection device 25 to the insulation case 10. This will not only fix the terminal protection device 25 firmly to the rear portion 103 of the insulated housing 10, but will also seal the terminal insulation cavities 30 from the flow of plastic during the over mold process. Moreover, because the inner dimensions of the terminal slots 253 are close to the outer terminal dimensions, glue placed around the terminal slots to support the terminals will not flow into the terminal insertion cavities 30.

The above-described embodiments of the present invention are intended to be illustrative only. Numerous alternative embodiments may be devised by those skilled in the art without departing from the scope of the following claims.

What is claimed is:

1. A connector, comprising:

an insulated housing including a head portion and a rear portion, wherein at least one terminal cavity is formed in the interior of the insulated housing, and at least one terminal cavity penetrates from the head portion to the rear portion;

at least one terminal received in the at least one terminal cavity, the terminal includes a head portion, a plate portion, an elastic portion connecting the head and plate portions and a tail portion extending from the plate portion; and a terminal protection device fixed at the rear portion of the insulated housing and having at least one terminal slot whose shape corresponds to the tail portion of the at least one terminal for being penetrated by the tail portion of at least one terminal and held by the plate, the at least one terminal slot having walls with an inwardly directed C-shaped cross section, and includes an anterior part, a barb and a posterior part from the side of the terminal protection device facing the rear portion to the other side, and the posterior part is narrower than the anterior part.

2. The connector in accordance with claim 1, wherein the terminal protection device is made of a plastic plate.

3. The connector in accordance with claim 1, wherein the posterior part is open on both sides.

4. The connector in accordance with claim 1, wherein the posterior part is covered by a seal layer.

5. The connector in accordance with claim 1, wherein a surface of the terminal protection device facing the rear portion of the insulated housing is provided with at least one fixing protuberance for fixing the terminal protection device to the rear portion of the insulated housing.

6. The connector in accordance with claim 1, wherein a surface of the terminal protection device facing the rear portion of the insulated housing is provided with at least one positioning protuberance, and at least one positioning slot for being engaged by a corresponding positioning protuberance.

7. A connector, comprising:

an insulated housing including a head portion and a rear portion, wherein at least one terminal cavity is formed in the interior of the insulated housing, and at least one terminal cavity penetrates from the head portion to the rear portion;

at least one terminal received in the at least one terminal cavity, the terminal includes a head portion, a plate portion, an elastic portion connecting the head and plate portions and a tail portion extending from the plate portion; and a terminal protection device fixed at the rear portion of the insulated housing and having at least one terminal slot whose shape corresponds to the tail portion of the at least one terminal for being penetrated by the tail portion of at least one terminal and held by the plate, the terminal protection device having a surface facing the rear portion of the insulated housing and provided with at least one filling protuberance to fill a notch at the rear portion of the insulated housing, the notch communicating with one of said terminal cavities.

* * * * *